United States Patent [19]

Noack

[11] 4,022,712

[45] May 10, 1977

[54] CATALYZED HYDRAZINE COMPOUND CORROSION INHIBITING COMPOSITION CONTAINING COMPLEX OF METAL SALT AND AMINO DERIVATIVE OF CARBOXYLIC ACID, AND ITS USE

[75] Inventor: Manfred G. Noack, Northford, Conn.

[73] Assignee: Olin Corporation, New Haven, Conn.

[22] Filed: Feb. 24, 1976

[21] Appl. No.: 660,808

[52] U.S. Cl. ..... 252/389 R; 21/2.5 R; 21/2.7 R; 106/14; 210/63 R; 252/8.55 E; 252/181; 252/184; 252/188; 252/392; 252/393

[51] Int. Cl.[2] ..... C23F 11/14; C23F 11/18

[58] Field of Search ..... 252/389 R, 392, 393, 252/8.55 E, 181, 184, 188; 21/2.7 R, 2.5 R; 106/14; 210/63 R

[56] References Cited

UNITED STATES PATENTS

| | | | |
|---|---|---|---|
| 3,645,896 | 2/1972 | Larsen | 252/390 |
| 3,728,281 | 4/1973 | Marks et al. | 252/392 |
| 3,843,547 | 10/1974 | Kaufman et al. | 252/392 |

*Primary Examiner*—Edward A. Miller
*Assistant Examiner*—Irwin Gluck
*Attorney, Agent, or Firm*—William A. Simons

[57] ABSTRACT

Corrosion inhibiting compositions are described which contain a hydrazine compound and an organometallic complex. The organometallic complex is the reaction product of a cobaltous, manganous, or cupric inorganic salt and one or more ligands comprising amino derivatives of carboxylic acids or salts. The use of these compositions as oxygen scavengers in corrosive environments is also described.

30 Claims, No Drawings

CATALYZED HYDRAZINE COMPOUND CORROSION INHIBITING COMPOSITION CONTAINING COMPLEX OF METAL SALT AND AMINO DERIVATIVE OF CARBOXYLIC ACID, AND ITS USE

The present invention is directed to catalyzed hydrazine compound corrosion inhibiting compositions and their use in corrosive environments. More particularly the present invention is directed to compositions comprising a hydrazine compound and a catalytic organometallic complex which enhances oxygen scavenging. The present invention is further directed to the use of these compositions to inhibit or reduce corrosion.

It is well known to use hydrazine compounds for the removal of oxygen from gases and liquids to retard the corrosion of metal surfaces. Among the more important commercial uses of hydrazine compounds for this purpose are in water and steam apparatus such as boilers, hot water heating systems and water cooling systems. These hydrazine compounds are also used in inorganic and organic fluid heat exchange systems e.g., alkylene glycol coolant systems. It is believed that the hydrazine compound reacts in the system so that hydrogen from the hydrazine compound combines with the oxygen to form water or other compound so as to bind up the oxygen and thereby inhibit corrosion.

The rate of reaction of a hydrazine compound, e.g., hydrazine, monomethyl hydrazine or the like, with oxygen at ambient temperatures or lower, is relatively slow. As a result, numerous suggestions have been made in the art to add catalytic or accelerating agents to the hydrazine compound to facilitate oxygen removal or scavenging in fluidic corrosive environments. Thus, it has been suggested that various catalysts be employed in conjunction with the hydrazine compound such as is described, for example, in U.S. Pat. Nos. 3,551,349 to Kallfass, 3,728,281 to Marks et al, 3,808,138 to Yamaguchi et al, and 3,843,547 to Kaufman et al.

It has now been discovered that certain compounds when used in combination with a hydrazine compound in corrosive environments significantly increase the rate of reaction of the hydrazine compound in removing oxygen and this is so to a surprisingly significant degree even at ambient or lower temperatures. The organometallic complexes used in the composition which comprise the present invention have not heretofore been taught or suggested in the prior art literature including the above-mentioned patents and yet they are high performers as hydrazine compound oxygen scavenging catalysts.

The novel compositions of the present invention contain a hydrazine compound and a catalytic organometallic complex, as mentioned. The hydrazine compound employed in the compositions of the present invention may be hydrazine itself or it may be any of the hydrazine compounds which function as oxygen scavengers in fluidic corrosive environments. Thus, hydrazine compound such as methylhydrazine, ethylhydrazine, propylhydrazine, butylhydrazine, 1,1-dimethylhydrazine, 1,1-dibutylhydrazine, and higher alkylated hydrazine compounds, hydroxyl alkyl hydrazines, for example, hydroxy ethyl hydrazine, as well as aromatic and aralkyl hydrazine compounds, may be employed. The hydrazine compound may be any of these or a mixture of these and may be used in anhydrous form or in an aqueous solution. The aqueous solution is, of course, the more preferred form when the composition is to be used in water-based corrosive environments. When organic fluid environments are involved the hydrazine compound may be used in an organic solution, e.g., in a lower alkylene glycol solution. In addition to the hydrazine compound mentioned, the inorganic and/or organic hydrazine compound salts may be employed to replace part or all of the hydrazine compound wherever compatible with the fluidic system. Suitable inorganic hydrazine compounds which may be used include hydrazine phosphate, hydrazine monohydrochloride and dihydrochloride, hydrazine monohydrobromide and dihydrobromide, monohydrosulfate and dihydrosulfate, and the like.

When the hydrazine compound is employed in combination with an inorganic or organic solvent, any workable solvent may be used as long as the solvent is compatible with the fluidic corrosive environment which is to be treated. There is no criticality in the amount of solvent employed because the solvent will be compatible with and may become part of the system which is to be treated. However, as a practical matter, regardless of the solvent chosen, generally at least about 1 mole to about 100 moles, and preferably about 1.5 moles to about 10 moles of the solvent is used per mole of hydrazine compound. The exact amount may be somewhat influenced by the particular hydrazine compound chosen or simply may be dictated by the commercial availability of particular solutions. For example, when an aqueous solution is used the solution may contain about 5 to about 64 percent hydrazine compound by weight, based on the total weight of the water and the hydrazine compound. When an organic solution is used, it may contain about 5 to about 40 percent by weight of hydrazine compound, for example, based on the total weight of the organic solvent and the hydrazine compound.

The organometallic complex used in the compositions of the present invention are reaction products of an inorganic salt and an organic ligand. Specifically, the inorganic salt is one of cobalt, manganese, or copper. The inorganic salt is represented by the formula:

$$MX_{(2/n)} \qquad (I)$$

wherein M is cobaltous, manganous, or cupric metal ion, X is an inorganic anion, and $n$ is the charge of the anion. Thus, the inorganic salt is one of cobalt, manganese, or copper in combination with two uninegative or one dinegative anion such as, for example, $NO_3^-$, $Cl^-$, $Br^-$, $I^-$, or $SO_4^{--}$. The inorganic salt may be used in the form of an aqueous solution or in its crystalline forms as desired. Preferred inorganic salts are the cobaltous and manganous salts.

In order to form the organometallic complex used in the composition of the present invention, the inorganic salt is reacted with one or more organic ligands selected from the group consisting of unsubstituted and inertly substituted amino derivatives of carboxylic acids and salts thereof. These organic ligands are aliphatic or aromatic compounds which may have only one amino group or may have two or more amino groups, as more fully described. The inert substituents which may be part of the organic ligand include any which do not interfere with the formation of the organometallic complexes and with the oxygen scavenger accelerating function of the compositions of the present invention and will include alkyl, aralkyl, alkaryl, and aryl groups, e.g., having about 1 to about 14 and preferably about 1 to about 7 carbon atoms, as well as inorganic substituents such as the sulfonic acid radical and the like. On the organic ligand is the required amino radical or radicals and the inert substituents may be located in any of the positions not occupied by the aforesaid amino radical or radicals.

The organic ligands which may be used in forming the organometallic complexes used in the composition of the present invention include those having the general formula:

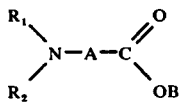

(II)

wherein A is a branched or straight chain alkylene biradical having about 1 to about 10 carbon atoms; B is hydrogen or any suitable metal ion which is capable of being replaced by cobaltous, manganous, or cupric ion; and $R_1$ and $R_2$ are each independently selected from the group consisting of hydrogen, lower alkyls, aryls, the radical:

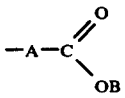

(III)

wherein A and B are defined above, and the radical:

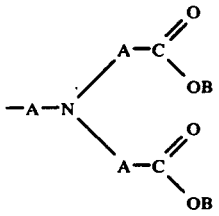

(IV)

wherein each A and B are independently selected from the groups defined for A and B above respectively.

Desirably the ligand used in preparing the compound of the present invention is one having the structure of Formula (II) above wherein A has 1 to 4 carbon atoms, $R_1$ and $R_2$ are each independently selected from the group consisting of hydrogen, alkyls having 1 to 10 carbon atoms, aryls having 6 to 14 carbon atoms and the radicals of Formulas (III) and (IV) above wherein A has 1 to 4 carbon atoms. Preferably, the ligand is one having the structure of Formula (II) above wherein A has 1 to 3 carbon atoms and $R_1$ and $R_2$ are each independently selected from the group consisting of hydrogen, alkyls having 1 to 4 carbon atoms and the radicals of Formulas (III) and (IV) above wherein A has 1 to 3 carbon atoms.

Exemplary of the most preferred ligands are glycine and its salts, having the formula:

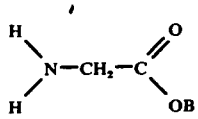

(V)

nitrilotriacetic acid (NTA) and salts, having the formula:

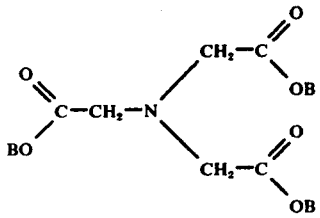

(VI)

and ethylenediamine tetraacetic acid (EDTA) and salts, having the formula:

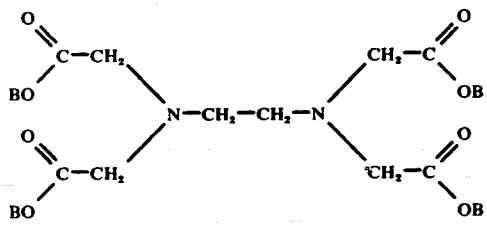

(VII)

wherein B for each of Formulas (V) through (VII) is as defined above, and especially wherein B is hydrogen.

Further, in addition to, but less desirably than the compounds represented by the foregoing, the organic ligands which may be used in forming the organometallic complexes used in the composition of the present invention also include those having the general formula:

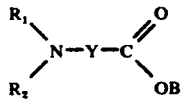

(VIII)

wherein B, $R_1$ and $R_2$ are as defined above, and wherein Y is a substituted or unsubstituted ortho arylene biradical.

Of the compounds represented by Formula (VIII) above, desirably Y is an ortho phenylene or toluene or naphthalene biradical, and $R_1$ and $R_2$ are each independently selected from the group consisting of hydrogen, alkyls having 1 to 10 carbon atoms, aryls having 6 to 14 carbon atoms and the radicals of Formulas (III) and (IV) above wherein A has 1 to 4 carbon atoms. Of the compounds represented by Formula (VIII) above, preferred are those wherein Y is an ortho phenylene or toluene or naphthalene radical, and $R_1$ and $R_2$ are each independently selected from the group consisting of hydrogen, alkyls having 1 to 4 carbon atoms, and the radicals of Formulas (III) and (IV) wherein A has 1 to 3 carbon atoms.

Exemplary of the compounds represented by Formula (VIII) are the following:

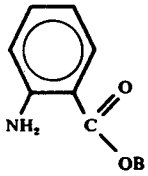

(IX)

-continued (X)

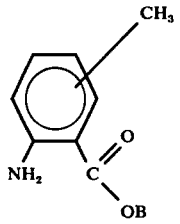

(XI)

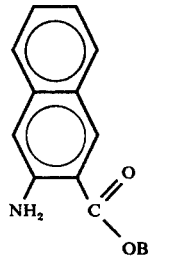

The organic ligand may effectively be employed in an aqueous or organic solvent solution. The amount of water or other solvent used for the inorganic salt and the amount of water or organic solvent used for the organic ligand will depend upon the compatibility of the particular inorganic salt, organic ligand, and solvents selected. However, in general about 5 to about 50 moles, and preferably about 20 to about 30 moles, of water or other appropriate solvent may be used per mole of inorganic salt. About 5 to about 40 moles and preferably about 20 to about 30 moles of water or organic solvent may be used in combination with the organic ligand. Among the preferred solvents for the organic ligand are water, and the lower alkylates, such as ethanol and methanol, and the like.

In forming the organometallic complexes, the inorganic salt as represented by Formula (I) above is reacted with one or more of the organic ligands represented by Formulas (II) to (XI) above so that about 0.1 to about 10 or even more moles, and preferably about 1 to about 4 moles of ligand is used per gram-atom of metal ion. These two components may advantageously be combined and reacted at room temperature and at atmospheric pressure. However, lower or higher temperatures and negative or positive pressures may be employed if desired. Thus, temperatures ranging from about 10° to about 100° C and preferably about 20° to about 50° C, and pressures as low as 5 psi up to about 30 psi, and preferably within the range of about 10 to about 15 psi, may be used. At any rate, it can be seen that any combination of temperature and pressure may be used in preparing the organometallic complex provided that there is no significant detrimental effect on the reaction or on the desired products.

The reaction of the inorganic salt and the organic ligand generally occurs in a very short period of time, e.g., instantaneously, and a significant amount of organometallic complex is obtained within a matter of seconds. The organometallic complex may be dissolved in the reaction mixture or it may precipitate out of the reaction mixture. Regardless of the particular form of the organometallic complex, the complex is compatible with the reaction mixture and may be stored therein for an indefinite period of time. Because the reaction occurs in most cases somewhat instantaneously, and because the desired product may be stored in the reaction mixture, there is no criticality to the residence time involved in the reaction between the inorganic salts and the organic ligands used in the present invention. However, if desired, the organometallic complex may be separated from the reaction mixture by any conventional means, e.g., by filtration or by distillation of the solvent. Alternatively, the organometallic compound need not be separated from the reaction mixture and the entire entity may be used as a component for the composition of the present invention.

The organometallic complex obtained may subsequently be combined with the hydrazine compound to form a composition of the present invention. In general, about 0.002 parts to about 0.04 parts of an organometallic complex is combined with one part by weight of the hydrazine compound. Preferably at least about 0.005 parts to about 0.02 parts of the organometallic complex is used per part of hydrazine compound to form the composition of the present invention. The organometallic complex and the hydrazine compound may be combined prior to use of the resulting composition as a corrosion inhibitor, or the two components may be combined by adding each of them to the fluid in the system to be treated. When an aqueous solution of the hydrazine compound is used, and this is particularly preferable for treating water containing systems, about 5 to about 64 percent by weight of the hydrazine compound and preferably about 10 to about 40 percent of the hydrazine compound may be used in combination with about 0.05 to about 5 percent and preferably about 0.2 to about 2 percent of the organometallic complex, the remainder being water.

As alternatives to combining the organometallic complex with the hydrazine compound either before or after being added to the fluidic corrosive environment to be treated, other approaches may advantageously be used. In one preferred embodiment, the organic ligand may be dissolved in a hydrazine compound solution and the inorganic salt either in solid or solution form may subsequently be combined with the organic ligand-hydrazine compound solution, either before or after the organic ligand-hydrazine compound solution is added to the fluid system to be treated. In another preferred embodiment of the present invention, the inorganic salt may first be dissolved in a hydrazine compound solution and then the organic ligand may be combined therewith either before or after the inorganic salt-hydrazine compound solution is added to the fluidic system to be treated. In yet another preferred embodiment, the hydrazine compound, the organic ligand and the inorganic salt may each independently be added to the fluidic corrosive environment to be treated. It should be noted that in those embodiments wherein the inorganic salt and the organic ligand are not combined until added to the fluidic system to be treated, the organometallic complex is formed in situ. It should also be noted that regardless of the particular combining approach taken the relative amount of hydrazine compound, organic ligand and inorganic salt used are those set forth above.

In the method of the present invention, the compositions are used to inhibit oxygen corrosion in fluidic corrosive environments, as mentioned. The compositions are generally combined with the system to be treated so that at least about a stoichiometric amount of hydrazine compound is present based on the amount of dissolved oxygen in the system. Typically, this may mean that the composition is used so that the hydrazine compound concentration in the fluidic system, after admixing, but before reaction with the dissolved oxygen takes place, is in the range of about 0.001 to about 1,000 ppm, e.g., about 0.01 to about 400 ppm. The particular method used in combining the corrosion inhibiting compositions of the present invention may be any of those which have been previously described and the physical techniques of addition may be any of those which are well known in the art with respect to the use of hydrazine as an oxygen scavenger. Likewise, the methods of determining the amount of oxygen present in a fluidic system are well known in the art and need not be described herein.

The following examples of the present invention are presented for illustrative purposes only, and the present invention should not be construed to be limited thereto.

EXAMPLE 1

Preparation of Hydrazine Solution with Co-EDTA Catalyst 1.6 grams of dihydrate of disodium ethylenediamine tetraacetate (4.3 m mol) are dissolved in 112 ml distilled water and 132 ml of 64 percent aqueous hydrazine solution are admixed to obtain a solution containing approximately 35 percent $N_2H_4$ by weight. A quantity of 5.23 ml of a 20 percent aqueous solution of $CoCl_2.6H_2O$ corresponding to 4.3 m mol $CoCl_2$ added subsequently produces a wine-red solution of Co-EDTA complex in aqueous hydrazine.

EXAMPLE 2

Preparation of Hydrazine Solution with Mn-EDTA Catalyst

Following the procedure of Example 1, one prepares an aqueous hydrazine solution containing approximately 35 percent $N_2H_4$ by weight from 0.3887 g dihydrate of ethylenediamine disodiumtetraacetate, 26.3 ml distilled $H_2O$, 33 ml of hydrazine hydrate and 1.27 ml of 12.3 percent Mn $SO_4$ solution. A water-white clear liquid containing Mn-complex of EDTA is obtained.

EXAMPLE 3

Preparation of Hydrazine Solution with Co-NTA Catalyst

The procedure of Example 1 is followed except for dissolving 1.187 grams of trisodium salt of nitrilotriacetic acid monohydrate instead of disodium salt of EDTA. A wine-red solution of NTA complex of cobalt in approximately 35 percent hydrazine is so obtained.

EXAMPLE 4

Monomethyl Hydrazine Solution with Co-NTA Catalyst

A solution of 0.279 grams of trisodium nitrilotriacetate monohydrate (1 m mol) in 37.4 ml of distilled water is mixed with 21 grams of monomethyl hydrazine. Subsequent addition of 1 millimol $CoCl_2$ in 1.23 ml $H_2O$ yields a wine-red solution of Co-NTA catalyst in approximately 35 percent aqueous solution of monomethyl hydrazine.

EXAMPLE 5

Determination of Catalytic Activity

Six identical test samples of air-saturated solution are prepared in six separate Erlenmeyer flasks of 1055 ml capacity by dissolving sodium carbonate and sodium hydrogen carbonate in distilled water until pH 10.0 is indicated by a pH meter equipped with glass electrode. Before measurements are carried out, each flask is heated and cooled as required to bring the solution contained therein to 25.0° C. Dissolved oxygen is then determined by means of a commercial oxygen meter equipped with selective membrane electrode. Solutions of hydrazine without catalyst, monomethyl hydrazine without catalyst, and the solutions prepared in accordance with Examples 1 through 4 (as shown in Table I) are then injected one at a time each into a separate flask in quantities sufficient to bring hydrazine or monomethyl hydrazine concentrations before reaction with oxygen approximately to 150 ppm. The subsequent decrease in oxygen concentration is then recorded as function of time as shown in Table I.

Table I

Chemical Oxygen Removal with Hydrazine and Monomethyl Hydrazine in Presence and Absence of Catalysts

| Solution | Catalyst | Time | $O_2$ Conc. in ppm vs. Time in Minutes | | | | |
|---|---|---|---|---|---|---|---|
| | | | 0 | 3 | 5 | 7 | 10 |
| $N_2H_4$ | None | | 8.7 | 7.4 | 6.8 | 6.4 | 6.0 |
| $CH_3—NH—NH_2$ | None | | 7.3 | 4.3 | 3.4 | 2.6 | 1.6 |
| $N_2H_4$ | Co-EDTA (Example 1) | | 8.3 | 0.07 | 0.05 | — | 0.03 |
| $N_2H_4$ | Mn-EDTA (Example 2) | | 7.7 | 3.4 | 1.9 | 0.8 | 0.06 |
| $N_2H_4$ | Co-NTA (Example 3) | | 8.1 | 4.0 | 2.0 | 0.4 | 0.03 |
| $CH_3—NH—NH_2$ | Co-NTA (Example 4) | | 7.7 | 3.9 | 2.1 | 0.9 | 0.04 |

As shown by the data in Table I, catalysts in accordance with this invention accelerate chemical oxygen removal with hydrazine or monomethyl hydrazine significantly.

EXAMPLE 6

Combination of Chelants

The procedure of Example 5 is repeated except that 14.06 mg of tetrasodium salt of ethylene diamine tetracetic acid is added to the test solution of pH 10.0 before addition of hydrazine solution prepared in accordance with Example 3, thus that before reaction with dissolved oxygen there are 150 ppm $N_2H_4$ present in the solution whereas cobalt, NTA and EDTA are present in molar ratio of 1:1:4.4. The data shown in Table II demonstrate that the ratio of metal salt and ligand components is not critical and also that one or more kinds of ligand component may be used.

Table III

Chemical Oxygen Removal with Catalyst Containing a Combination of Ligand

| Solution | Metal Salt Component | Ligand 1 | Ligand 2 | Time | Oxygen Conc. in ppm vs. Time in Minutes 0 | 3 | 10 |
|---|---|---|---|---|---|---|---|
| Example 6 | $CoCl_2$ | NTA | EDTA | | 8.0 | 0.04 | 0.02 |

What is claimed is:

1. A composition, comprising:
a. a hydrazine compound; and
b. about 0.002 parts to about 0.04 parts by weight of an organometallic complex per part of hydrazine compound, said organometallic complex being the reaction product of:
i. an inorganic salt selected from the group consisting of cobaltous, manganous, and cupric salts; and
ii. at least one organic ligand selected from the group consisting of unsubstituted amino derivatives of carboxylic acids, substituted amino derivatives of carboxylic acids wherein the substituents are inert and salts of said unsubstituted and substituted derivatives.

2. The composition of claim 1 wherein said inorganic salt has the formula:

$$MX_{(2/n)} \quad (I)$$

wherein M is a cobaltous or manganous metal ion, X is an inorganic anion, and $n$ is the charge of the anion.

3. The composition of claim 1 wherein said hydrazine compound is in anhydrous form.

4. The composition of claim 1 wherein said hydrazine compound is in an aqueous solution containing about 5 to about 64 percent hydrazine compound by weight, based on the total weight of the water and the hydrazine compound.

5. The composition of claim 1 wherein about 0.005 parts to about 0.02 parts by weight of the organometallic complex is used per part of hydrazine compound.

6. The composition of claim 5 wherein said organometallic complex is the reaction product of an inorganic salt as recited, and one or more ligands having one of the formulas:

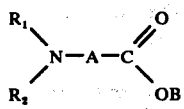
(II)

wherein A is a branched or straight chain alkylene biradical having about 1 to about 10 carbon atoms; B is hydrogen or any suitable cation which is capable of being replaced by cobaltous, manganous, or cupric ion; and $R_1$ and $R_2$ are each independently selected from the group consisting of hydrogen, lower alkyls, aryls, the radical:

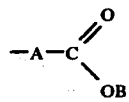
(III)

wherein A and B are defined above, and the radical:

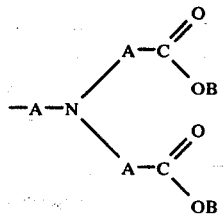
(IV)

wherein each A and B are independently selected for the groups defined for A and B respectively; and

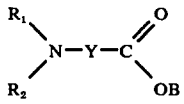
(VIII)

wherein Y is a substituted or unsubstituted ortho arylene biradical; and wherein B, $R_1$ and $R_2$ are as defined above.

7. The composition of claim 6 wherein said hydrazine compound is in an organic solvent solution containing about 5 to about 40 percent hydrazine compound by weight, based on the total weight of the organic solvent and the hydrazine compound.

8. The composition of claim 6 wherein said organometallic complex is the reaction product of an inorganic salt as recited, and one or more ligands represented by Formula (II) above.

9. The composition of claim 8 wherein, the ligand is one having the structure of Formula (II) above wherein A has 1 to 3 carbon atoms, and $R_1$ and $R_2$ are each independently selected from the group consisting of hydrogen, alkyls having 1 to 4 carbon atoms and the radicals of Formulas (III) and (IV) above wherein A has 1 to 3 carbon atoms.

10. The composition of claim 1 wherein said organic ligand for said organometallic complex is selected from the group consisting of glycine, nitrilotriacetic acid, ethylene diamine tetraacetic acid, and their salts.

11. A method of treating a fluidic corrosive environment to remove oxygen therefrom and inhibit corrosion therein, which comprises: treating said environment with a composition comprising:
a. a hydrazine compound; and
b. about 0.002 parts to about 0.04 parts by weight of an organometallic complex per part of hydrazine compound, said organometallic complex being the reaction product of:
i. an inorganic salt selected from the group consisting of cobaltous, manganous, and cupric salts; and
ii. at least one organic ligand selected from the group consisting of unsubstituted amino derivatives of carboxylic acids, substituted amino derivatives of carboxylic acids wherein the substituents are inert and salts of said unsubstituted and substituted derivatives.

12. The method of claim 10 wherein said inorganic salt has the formula:

$$MX_{(2/n)} \quad (I)$$

wherein M is a cobaltous, manganous, or cupric metal ion, X is an inorganic anion, and *n* is the charge of the anion.

13. The method of claim 12 wherein said hydrazine compound is in anhydrous form.

14. The method of claim 11 wherein said hydrazine compound is in an aqueous solution containing about 5 to about 64 percent hydrazine compound by weight, based on the total weight of the water and the hydrazine compound.

15. The method of claim 11 wherein about 0.005 parts to about 0.02 parts by weight of the organometallic complex is used per part of hydrazine compound.

16. The method of claim 5 wherein said organometallic complex is the reaction product of an inorganic salt as recited, and one or more ligands having the formula:

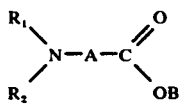

(II)

wherein A is a branched or straight chain alkylene biradical having about 1 to about 10 carbon atoms; B is hydrogen or any suitable metal ion which is capable of being replaced by cobaltous, manganous, or cupric ion; and $R_1$ and $R_2$ are each independently selected from the group consisting of hydrogen, lower alkyls, aryls, the radical:

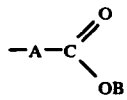

(III)

wherein A and B are defined above, and the radical:

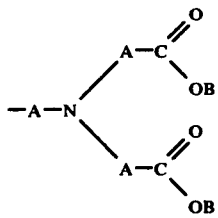

(IV)

wherein each A and B are independently selected for the groups defined for A and B respectively; and

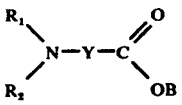

(VIII)

wherein Y is a substituted or unsubstituted ortho arylene biradical; and B, $R_1$ and $R_2$ are as defined above.

17. The method of claim 16 wherein said hydrazine compound is in an organic solvent solution containing about 5 to about 40 percent hydrazine compound by weight, based on the total weight of the organic solvent and the hydrazine compound.

18. The method of claim 16 wherein said organometallic complex is the reaction product of an inorganic salt as recited, and one or more ligands represented by Formula (II) above.

19. The method of claim 18 wherein the ligand is one having the structure of Formula (II) above wherein A has 1 to 3 carbon atoms, and $R_1$ and $R_2$ are each independently selected from the group consisting of hydrogen, alkyls having 1 to 4 carbon atoms and the radicals of Formulas (III) and (IV) above wherein A has 1 to 3 carbon atoms.

20. The method of claim 11 wherein said organic ligand for said organometallic complex is selected from the group consisting of glycine, nitrilotriacetic acid, ethylene diamine tetraacetic acid, and their salts.

21. The method of treating a fluidic corrosive environment to remove oxygen therefrom and inhibit corrosion therein, which comprises:

adding the following components to said environment:

a. a hydrazine compound in at least about a stoichiometric amount, based on the amount of oxygen to be removed;

b. an inorganic salt having the formula:

$$MX_{(2/n)} \quad (I)$$

wherein M is a cobaltous, manganous, or cupric metal ion, X is an inorganic ion, and *n* is the charge of the ion; and c. at least one organic ligand selected from the group consisting of unsubstituted amino derivatives of carboxylic acids, substituted amino derivatives of carboxylic acids wherein the substituents are inert and salts of said unsubstituted and substituted derivatives and wherein about 0.1 to about 10 moles of ligand are used per gram-atom of metal ion and wherein from about 0.002 parts to about 0.04 parts by weight of total organic ligand and inorganic salt are used per part of said hydrazine compound.

22. The method of claim 21 wherein each of said components are added separately to said environment.

23. The method of claim 21 wherein said organic ligand and said hydrazine compound are combined prior to being added to said environment.

24. The method of claim 21 wherein said inorganic salt and said hydrazine compound are combined prior to being added to said environment.

25. The method of claim 21 wherein said inorganic salt and said organic ligand are combined prior to being added to said environment.

26. The method of claim 21 wherein about 0.005 parts to about 0.02 parts by weight of total organic ligand and inorganic salt are used per part of said hydrazine compound.

27. The method of claim 26 wherein each of said components are added separately to said environment.

28. The method of claim 26 wherein said organic ligand and said hydrazine compound are combined prior to being added to said environment.

29. The method of claim 26 wherein said inorganic salt and said hydrazine compound are combined prior to being added to said environment.

30. The method of claim 26 wherein said inorganic salt and said organic ligand are combined prior to being added to said environment.

* * * * *